US005365299A

United States Patent [19]

Desai

[11] Patent Number: 5,365,299

[45] Date of Patent: Nov. 15, 1994

[54] SYSTEM AND APPARATUS FOR THE PROCESSING OF A PHOTOSENSITIVE SHEET MATERIAL AND AN ASSOCIATED METHOD

[75] Inventor: Basavaraji R. Desai, Knoxville, Tenn.

[73] Assignee: Picture Productions Limited Partnership, Knoxville, Tenn.

[21] Appl. No.: 672

[22] Filed: Jan. 5, 1993

[51] Int. Cl.[5] ..... G03D 3/08; G03D 3/02

[52] U.S. Cl. ..... 354/319; 354/324

[58] Field of Search ..... 354/331, 336, 317, 319, 354/324; 134/122 P, 64 P, 122 R, 64 R

[56] References Cited

U.S. PATENT DOCUMENTS

| | | | |
|---|---|---|---|
| 4,647,173 | 3/1987 | Schär | 354/319 |
| 4,845,019 | 7/1989 | Vaughan, IV | 430/422 |
| 4,945,934 | 8/1990 | Vaughn, IV | 354/317 |
| 4,977,422 | 12/1990 | Vaughan, IV | 354/317 |
| 4,989,028 | 1/1991 | Hall et al. | 354/324 |
| 5,022,418 | 6/1991 | Vaughan, IV | 134/64 |
| 5,144,474 | 9/1992 | Keable et al. | 354/319 |
| 5,266,994 | 11/1993 | Desai et al. | 354/317 |

*Primary Examiner*—D. Rutledge

*Attorney, Agent, or Firm*—Luedeka, Neely & Graham

[57] ABSTRACT

A system and method for processing a flexible photosensitive sheet or web material (PSM) including a photographic emulsion on at least one of the faces thereof employs a reservoir cell having an elongated cavity for containing a relatively small quantity of processing solution held therein in a sheet-like configuration and through which the PSM is routed during a processing operation. A pump is associated with the cell for circulating processing solution through the cell cavity from one end of the cavity to the other end thereof to enhance the distribution and mixing of the processing solution within the cavity. There is also associated with the cell a flat strip of substantially air-impermeable material for engagably overlying a substantial portion of the upper surface of the processing solution contained within the cavity to reduce the likelihood of oxidation of the solution if left within the cell for a prolonged period of time. The cell also includes an electric heating element secured in heat exchange relationship with the body of the cell and appropriate controls for controlling the temperature of the reservoir and to thereby control the temperature of the processing solution contained within the cell.

21 Claims, 6 Drawing Sheets

5

SYSTEM AND APPARATUS FOR THE PROCESSING OF A PHOTOSENSITIVE SHEET MATERIAL AND AN ASSOCIATED METHOD

BACKGROUND OF THE INVENTION

This invention relates generally to the processing of photosensitive sheet material and more particularly is concerned with the processing of photosensitive sheet material with a relatively small amount of liquid processing solution, such as developer solution.

Photosensitive sheet material (PSM) as used herein and with which this invention is concerned is intended to include a substantially flexible base sheet or web and a coating of photographic emulsion carried on at least one of the major faces of the sheet. Commonly, the emulsion includes a plurality of layers wherein each layer is designed to produce a specific result when allowed to react with developer solution. For example, in the photographic art, reproduction of an image is commonly accomplished by exposing a photosensitive material such as, for example, a photographic film or paper, to light reflected from an object or image, and then the exposed PSM is thereafter developed to produce a reproduction, i.e., print of the image. Development of such flexible PSM commonly includes the subjecting of the PSM to a series of processing steps, such as immersing the emulsion-carrying face in a developer solution to bring forth the desired image.

Developer solutions comprise combinations of chemicals, generally in aqueous solution, wherein each of the chemicals is chosen to react with one or more of the constituents in one or more of the layers of the emulsion to produce a specific result. The quality of the resulting product depends, to a large extent, upon the nature of the physical contact of the PSM with the developer solution. However, chemical reactions which occur during development of a PSM generate by-products that are taken up in the developer solution which, in turn, renders the developer solution less effective. Therefore, it is important that during a development process, developer solution in contact with the PSM be cyclically exchanged to continuously expose the PSM to fresh or less-depleted solution.

The type of apparatus with which this invention is concerned includes a reservoir cell including an internal cavity for containing a processing solution, such as a developer solution, so that the body of solution contained within the cell cavity is substantially sheet-like in form (a continuous layer). During a processing step with such a reservoir cell, a PSM is routed edgewise through an opening provided in the reservoir and into the body of solution contained therein and conveyed through the cavity so that the processing solution acts upon the PSM in a desired manner and for a predetermined period of time. The apparatus may include a series of such reservoir cells arranged in a side-by-side arrangement so that conveyance of a PSM in sequence through the cells exposes the PSM in succession to the working fluid contained within each cell. The number of cells and the characteristics of the solution contained within each cell depends upon the characteristics which the PSM is desired to exhibit when processed. In addition, the rate at which the PSM is conveyed through any one cell and the rate of replenishment of the fluid contained within the one cell are commonly coordinated to control the exposure of the PSM to the working fluid within the one cell.

A reservoir cell of the aforedescribed class is shown and described in co-pending patent application Ser. No. 07/679,762, now U.S. Pat. No. 5,266,994, the disclosure of which is incorporated herein by reference. In one embodiment of the reservoir cell described in the referenced application, there is provided a plurality of elongated woven fabric loops which are secured to the upper part of the reservoir cell so that the bight of the loop extends downwardly into the reservoir cavity. A PSM which is moved through the cavity of such a cell slidably moves in contact with the underside of the loops so that the volumetric amounts of developer solution in contact with the emulsion is replaced with fresh or less-depleted volumetric amounts of developer solution. Heretofore, however, the distribution of replacement solution throughout the cavity was, to a large extent, unpredictable. It would therefore be desirable to provide a reservoir cell wherein the distribution of replacement solution with depleted solution through the cell cavity improved.

There are many processing chemicals, e.g., those which possess a pH greater than 11.0, which are highly susceptible to oxidation when exposed to air. When such a chemical remains within a cell of the aforedescribed class for a prolonged period of time, such as overnight, the chemical loses some of its effectiveness and may be rendered undesirable. It would be desirable to provide a reservoir cell wherein the likelihood of oxidation of processing solution contained within the cell cavity is substantially reduced so that if the solution is left within the cell for a prolonged period of time, the effects of oxidation of the solution are also reduced.

It is also well known that photographic processing operations are quite sensitive to temperature changes. Depending upon the process, temperatures may need to be held within ranges of between ±0.5° F. to ±2.0° F. from a base temperature for consistency and optimum results. In processing applications of the type with which this invention is concerned, i.e., those involving a relatively small amount of liquid processing solution, and especially solution disposed in a sheet-like form, an appreciable differential between the temperature of a reservoir cell and that of the working fluid introduced into the cell may alter, e.g., cool, the temperature of the introduced working fluid to such an extent that the temperature of the process operation is outside of an acceptable range. It would therefore be desirable to provide a reservoir cell wherein the temperature of the working fluid contained therein can be accurately controlled.

An aspect of the present invention is to provide a new and improved system and method utilizing a reservoir cell of the aforedescribed class wherein the distribution of processing solution throughout the cell cavity is enhanced.

Another aspect of the present invention is to provide a new and improved reservoir cell of the aforedescribed class which reduces the likelihood of aerial oxidation of processing solution contained within the cell cavity.

Still another aspect of the present invention is to provide a new and improved system and method utilizing a reservoir cell of the aforedescribed class wherein the temperature of the working fluid contained within the cell can be accurately controlled.

SUMMARY OF THE INVENTION

This invention resides in a system, apparatus and method for use in the processing of a flexible PSM having a photographic emulsion on at least one of the faces thereof. Each of the system, apparatus and method utilizes a reservoir having an elongate cavity for containing a relatively small amount of processing solution through which the PSM is moved during a processing operation and means supported within the cavity for cooperating with the PSM as the PSM is moved through the cavity for dispersing the processing solution in contact with the emulsion-bearing face of the PSM. The cavity is shaped so that the processing solution contained therein assumes the shape of a substantially sheet-like body, i.e., a continuous layer.

The system of the invention includes the above-described reservoir and means associated with the reservoir for moving processing solution from one end of the cavity to the other end of the cavity to enhance the distribution of processing solution across the emulsion-bearing face of the PSM during a processing operation. This solution movement induces agitation which is an important and desirable factor in photographic processing.

One embodiment of the method of the invention includes steps involved when using the aforedescribed system. In particular, the above-described reservoir is provided and the processing solution is moved from one end of the cavity to the other end of the cavity so that as the PSM is moved through the cavity, the distribution of processing solution across the emulsion-bearing face of the PSM is enhanced.

In an embodiment of the apparatus of the invention, the cavity has a roof and a shape so that processing solution contained within the cavity has an upper surface which is spaced from the roof of the cavity so as to provide a spacing between the upper surface of the processing solution contained within the reservoir and the roof of the cavity. The apparatus also includes means disposed within the cavity for engagably overlying a substantial portion of the upper surface of the processing solution contained within the cavity to isolate a substantial portion of the upper surface from the spacing between the upper surface of the solution and the cavity roof to reduce the likelihood of oxidation of the processing solution from the air contained within the spacing.

In another embodiment of the apparatus of the invention, means are associated with the reservoir for controlling the temperature of the reservoir to thereby control the temperature of the processing solution contained within the reservoir. Another embodiment of the method of the invention includes steps involved when using this another embodiment of the apparatus. In particular, the reservoir is provided and the temperature of the processing solution is controlled by controlling the temperature of the reservoir.

BRIEF DESCRIPTION OF THE ILLUSTRATED EMBODIMENTS

DETAILED DESCRIPTION OF THE ILLUSTRATED EMBODIMENTS

Figure 1:
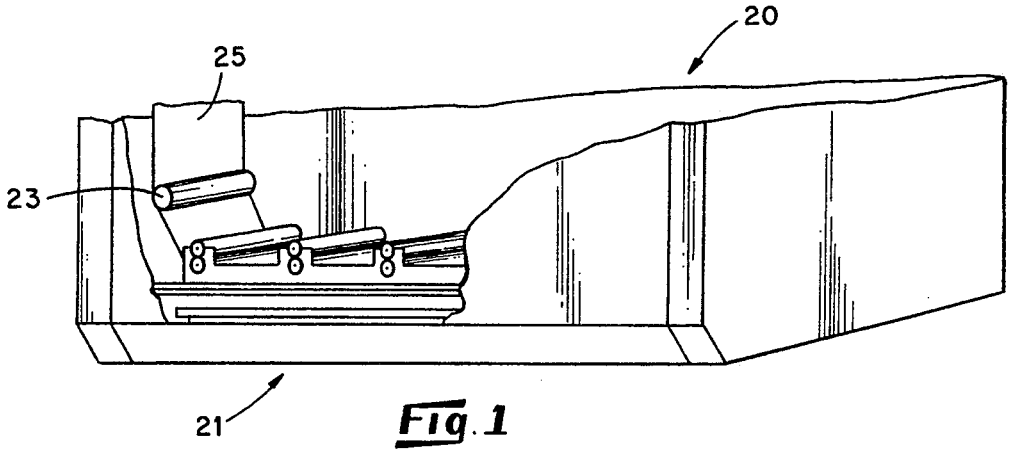
FIG. 1 is a schematic perspective view of processing equipment, shown cut-away, within which features of the present invention are incorporated and with which the method of the present invention is carried out.

Turning now to the drawings in greater detail, there is shown in FIG. 1 an apparatus 20 having a development system 21 for use when developing an exposed photosensitive sheet material 25. In the depicted system 21, the PSM is conveyed downwardly into the development system 21 by a conveyor system including rollers 23 across which the PSM is routed, but it will be understood that conveyance of the PSM to the development system 21 can be effected with any of a number of alternative means.

Figure 2:
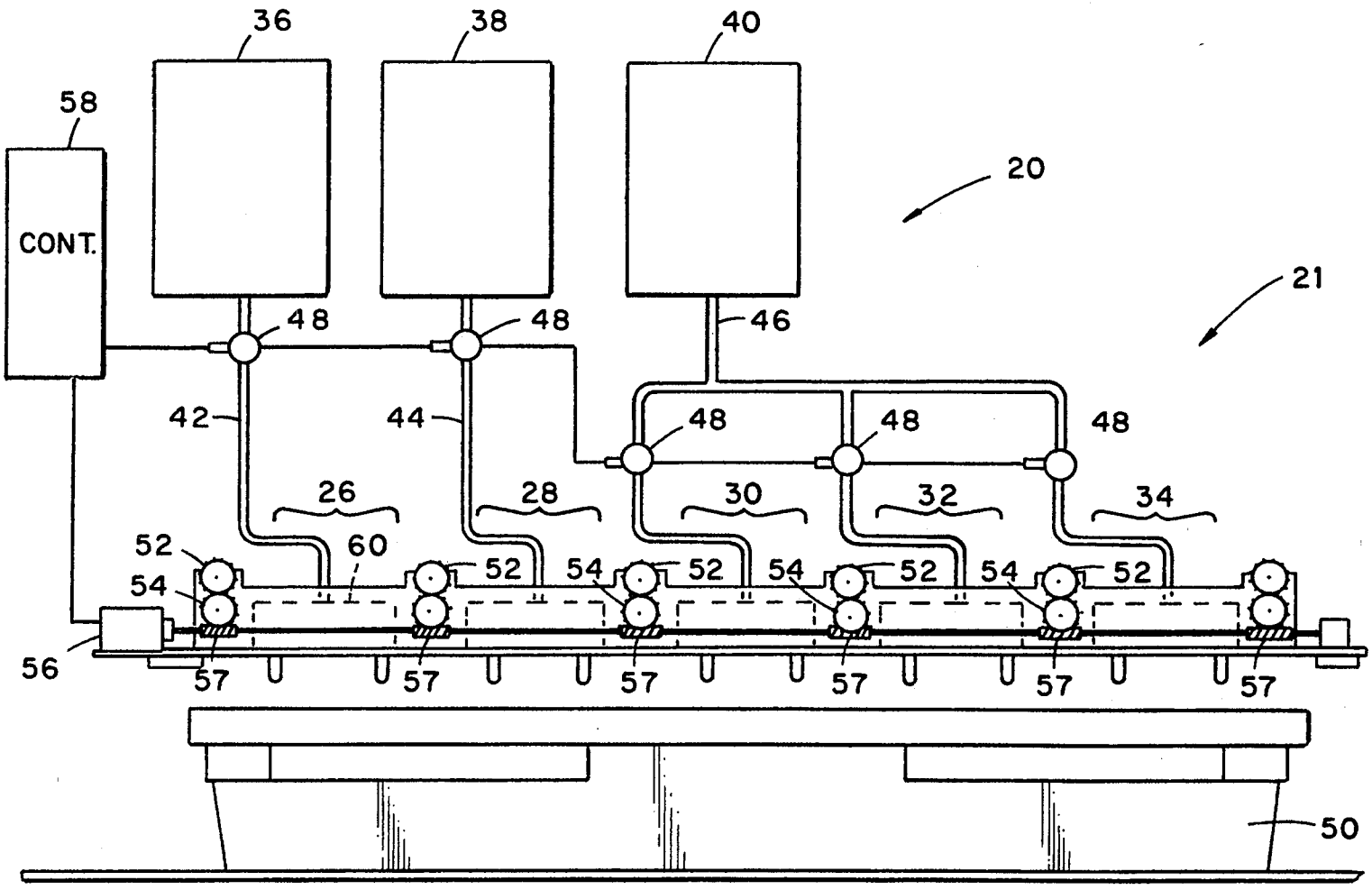
FIG. 2 is an elevation view of a fragment of the FIG. 1 equipment illustrating schematically the developing system of the FIG. 1 equipment.

With reference to FIGS. 1 and 2, the development system 21 includes a plurality of stations 26, 28, 30, 32, 34 at which various processes are performed upon the PSM. The PSM includes a substantially flexible base sheet or web and a coating of photographic emulsion carried on at least one of the two side faces of the base sheet. The emulsion is usually present in one or a plurality of layers which when processed, produce a specific result so that when the PSM is viewed, the latent image in the PSM is developed into a visible image.

For purposes of developing the PSM, the depicted development system 21 includes an amount of a developer solution at the first station 26, an amount of a fixer solution at the second station 28 and an amount of water at each of the third station 30, fourth station 32 and fifth station 34 for washing the PSM after its exposure to the solutions at the first and second stations 26 and 28. It will be understood, however, that other solutions can be employed. In the depicted system 20, the developer solution for use at the first station 26 is contained within a reservoir 36, the fixer solution for use at the second station 28 is contained within a reservoir 38 and water for use at the third, fourth and fifth stations 30, 32 and 34 is contained within a reservoir 40. The fluid contained within each reservoir 36, 38 or 40 is fed through a conduit 42, 44 or 46 to the corresponding station. Control of the flow of solution between each reservoir and its corresponding station may be effected by a metered pump 48 mounted in each conduit 42, 44 or 46. Any excess or overflow of fluid from the stations is captured in an overflow tray 50 for subsequent disposal.

During a development process with the system 21, the PSM is fed edgewise, preferably at a constant rate of movement, in sequence through the stations 26, 28, 30, 32, 34. To this end, the system 21 includes an arrangement of feed rolls 52, 54 between which the PSM is positioned for advancement through the stations. The feed rolls 52, 54 are suitably connected to a drive motor 56 through worm gear arrangements 57 so that operation of the drive motor 56 rotates the feed rolls 52, 54 in the appropriate directions. The system 20 also includes a computer controller 58 for controlling the operation of the drive motor 56 and the operations of the system 21 as will be apparent herein. Accordingly, the drive motor 56 is wired to the controller 58 for receiving commands therefrom.

Whereas five stations are depicted in the system 21 of FIG. 2, it will be recognized that other or additional stations may be employed to accommodate different processing needs. Moreover, the system 21 is depicted schematically in FIG. 2 and it is recognized that a complete system includes elements that are not depicted, such as mounting means, housings, relays and other components which may be supplied readily by one skilled in the art.

Figure 3:
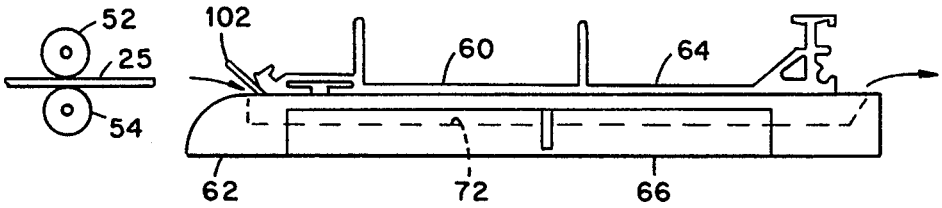
FIG. 3 is an end elevation view of a reservoir cell positioned at one station of the FIG. 2 system.
Figure 4:
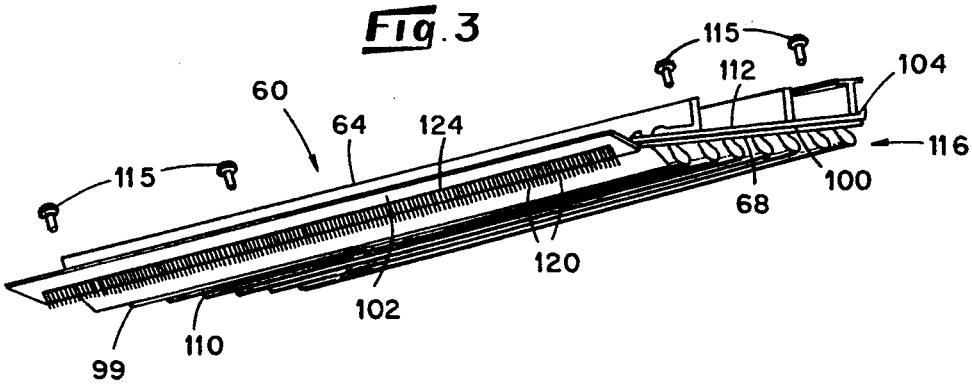
FIG. 4 is a perspective view of the reservoir cell of FIG. 3, shown exploded.
Figure 4:
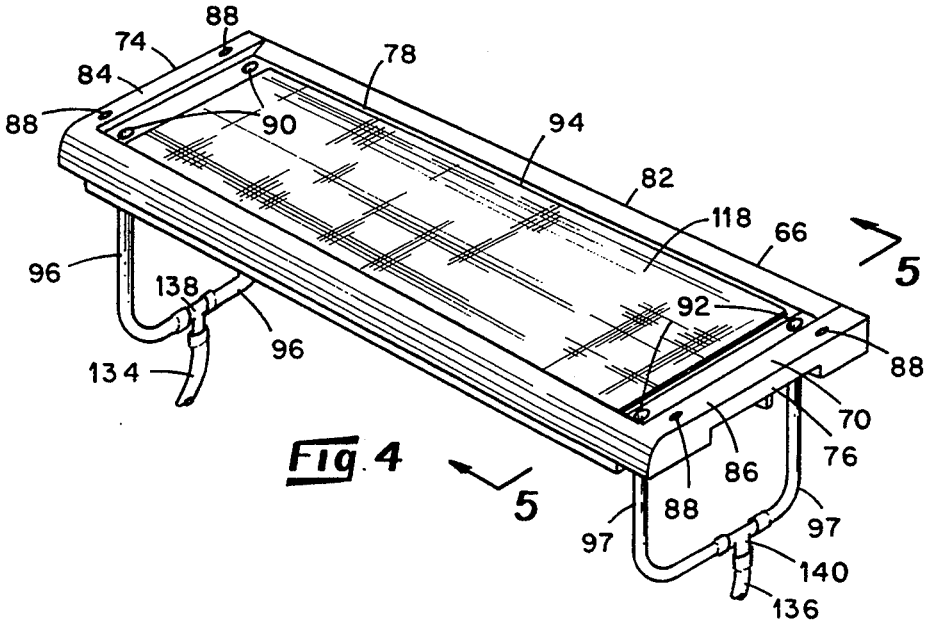
Figure 5:
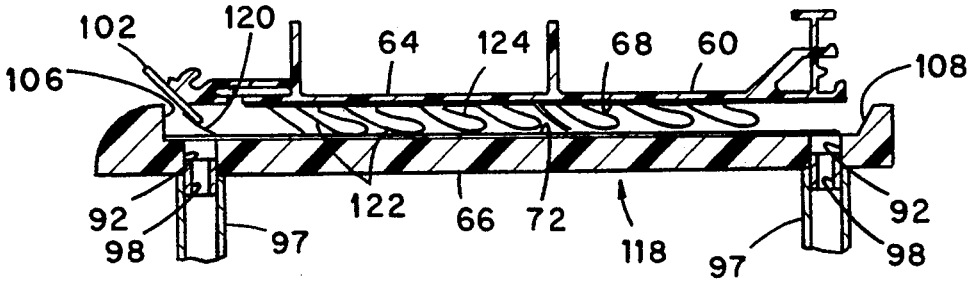
FIG. 5 is a cross-sectional view of the FIG. 3 reservoir cell taken about along line 5—5 of FIG. 4.

With reference to FIGS. 3–5, there is illustrated an embodiment of a containment vessel, or reservoir cell 60, situated at one station, i.e. the first station 26, of the developing system 21. The cell 60 includes housing means 62 including top and bottom generally rectangular housing sections 64 and 66, respectively. These top and bottom sections 64, 66 include side faces 68, 70, respectively, and are arranged so that the side faces 68, 70 face one another and provide between the sections 64 and 66 a relatively thin liquid cavity 72 for containing processing solution. This liquid cavity 72 is adapted to hold a relatively small quantity of solution, e.g. 250 cc, in a sheet-like form and is not to be compared with vats for containing large quantities of solution due to the fact that in applications involving vats, efficient use of small amounts of solutions for distribution within the vats normally is not much of a concern. Accordingly, the cavity 72 may possess an exemplary length of about 17.5 inches, a width of about 4.5 inches, and a depth of about 0.18 inches. However, it will be understood that the length and width of the cavity 72 may possess any dimension within a relatively broad range, but the depth will remain relatively shallow. As will be apparent herein, the top and bottom sections 64, 66 mate with one another in a manner which accommodates easy assembly and disassembly of the cell 60.

As best shown in FIG. 4, the bottom section 66 is elongated in shape having two opposite ends 74, 76 and defines within its side face 70 a relatively shallow recess 78 bounded by a forward edge 80, a rearward edge 82 and two end edges 84, 86. Provided along each of the end edges 84, 86 of the face 70 are internally-threaded openings 88 whose purpose will become apparent herein. The bottom section 66 is also provided with through-openings, such as those indicated, 90 or 92, adjacent each end 74 or 76 which extend from the underside of the section 66 and open into the bottom, indicated 94, of the recess 78. As will be apparent herein, the openings 90 disposed adjacent one end 74 of the bottom section 66 provides inlet ports for solution conducted into the reservoir cavity 72 while the openings 92 provided adjacent the opposite end 76 of the bottom section 66 provides outlet ports for solution conducted out of the reservoir cavity 72. To facilitate the attachment of hoses 96 or 97 (FIG. 4) to the openings 90 or 92, there is provided a nipple member 98 (FIG. 5) which is sealingly attached within each opening 90 or 92 so as to depend downwardly from the underside of the bottom section 66.

The bottom surface of the recess 78 of the bottom section 66 is provided with a woven fabric or screen 118 or the like which overlies substantially its entire surface area. Preferably such screen 118 is anchored to the recess surface at spaced locations thereby ensuring that the screen 118 serves to disrupt any tendency of the flat surface of the PSM, when wetted, to adhere to the recess surface due to the attractive forces exerted by a thin film of liquid therebetween.

With reference again to FIG. 4, the top section 64 is elongated in shape and has two opposite ends 99, 100, and the side face 68 of the top section 64 extends between the ends 74, 76 and provides the roof of the cavity 72. The length and width dimensions of the top section 64 correspond generally to those of the bottom section 66 so that when the top section 64 is positioned in overlying relationship with the bottom section 66, each of its forward, rearward and end edges correspond generally with those of the bottom section 66. The forward edge, indicated as 102, of the top section 64 is offset from the forward edge 80 of the bottom section 66 so as to provide an elongated entrance passageway 106, best shown in FIG. 5, through which the PSM is introduced into the reservoir cavity 72. Similarly, the rearward edge, indicated 104, is spaced from the rearward edge 82 of the bottom section 66 for a distance therealong so as to provide an elongated exit passageway 108 through which the PSM exits the cavity 72. Furthermore, there is provided along each of the end edges, indicated 110 and 112, of the top section 64 a pair of through-openings which each aligns with a corresponding internally-threaded opening 88 of the bottom section 66 when the top section 64 is placed over the bottom section 66 for receiving the shank of a screw 115 inserted through the through-opening 114 and tightened within the corresponding opening 88. With the top section 64 secured to the bottom section 66 in this manner, the top section 64 is restrained from moving or shifting rearwardly as the PSM passes through the cavity 72 and accommodates easy assembly and disassembly of the top and bottom sections 64 and 66.

With reference still to FIG. 4, the reservoir cell 60 includes means, generally indicated as 116, for dispersing the working fluid, i.e. the developer solution, adjacent the faces of the PSM as the PSM is moved through the cavity 72 and thereby enhancing the exposure of the emulsion borne by a face of the PSM to fresh or less-depleted processing solution contained within the cavity 72. In the depicted cell 60, the dispersing means 116 includes the screen 118, introduced earlier, associated with the bottom section 66 and a plurality of fingers 120 and loops 122 associated with the top section 64. The fingers 120 are provided by weft strands of a strip 124 of woven fabric which is attached against the forward edge 102 of the top section 64 so that the strands of the strip 124 depend generally downwardly from the forward edge 102. The loops 122 are provided by an elongated sheet of flexible material, such as a mesh or screen fabric, which is formed into a series of loops 122 which each provide in cross-section a generally U-shaped form. The legs of each loop 122 are secured to the face 64 of the top section 64 so that the bight of each loop 122 depends downwardly into the cavity 72 and is immersed in the processing solution contained therein. During operation of the cell 60, these loops 122 aid in the distribution of solution throughout the cavity 72 as the PSM is moved therethrough.

As a PSM is routed edgewise through the cavity 72 from the entrance passageway 106, the fingers 120 disperse the solution on the PSM, and the loops 122 and screen 118 cooperate with the moving PSM to effect distribution and microagitation of the solution adjacent the faces of the PSM contained within the cavity 72. For a more detailed description of the structure and operation of each of the screen 118, fingers 120 and loops 122, reference may be had to co-pending patent application Ser. No. 07/679,762, the disclosure of which is incorporated herein by reference. By continually agitating and thereby disturbing the solution adjacent the faces of the PSM in this manner, only a relatively small quantity of solution is required to develop the PSM or, more specifically, the emulsion(s) borne by the PSM.

Figure 6:
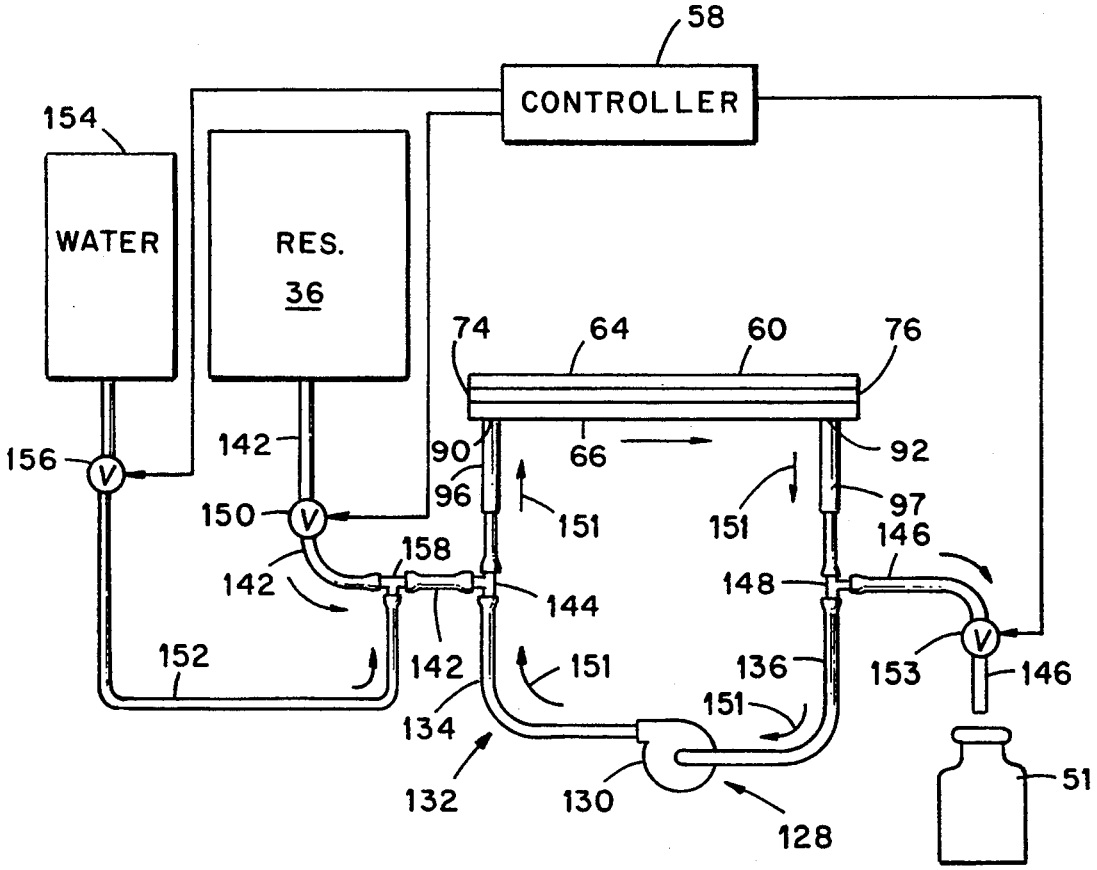
FIG. 6 is a view of a system utilizing the reservoir cell of FIG. 3 and illustrating schematically the circulation of working fluid through the cell.

With reference to FIG. 6, the FIG. 1 system 21 also includes means, generally indicated as 128, for moving the working fluid, e.g., processing solution, from one end 74 of the cavity 72 to the other end 76 thereof. In the depicted system 21, the moving means 128 includes a low-volume circulation pump 130, e.g. less than about 2.0 liters per minute, for circulating the processing solution through the cavity 72 by way of a network 132 of hoses joined to form a loop. The hose network 132 includes the hoses 96 and 97, introduced earlier, and hoses 134, 136 joined to the outlet and inlet, respectively, of the pump 130. The hoses 154 and 96 are joined in series with one another between the cell inlet ports 90 and the outlet of the pump 130 by means of suitable connection members, such as the fitting 138 shown in FIG. 4. Similarly, the hoses 136 and 97 are joined in series with one another between the cell outlet ports 92 and the inlet of the pump 130 by means of suitable connection members, such as the fitting 140 shown in FIG. 4.

During operation of the pump 130, working fluid, i.e., processing solution, is drawn from the cavity 72 through the outlet ports 92 provided at the end 76 of the bottom section 66 and returned to the cavity 72 through the inlet ports 90 provided at the other end 74 of the bottom section 66 in a flow direction which corresponds with the flow direction arrows 151 in FIG. 6. As the working fluid is circulated through the cavity 72 in this manner, the fluid flows through the cell cavity 72 generally along predictable paths beginning at locations adjacent one cavity end 72 and terminating at locations adjacent the opposite cavity end 74 and maintains the fluid within the cell 72 in a well-mixed condition. Since the PSM routed through the cell cavity 72 travels from the entrance passageway 106 to the exit passageway 108 as the pump 130 is operated, the flow of the working fluid through the reservoir cell 60 by means of the pump 130 is generally normal to the direction of movement of the PSM through the cell 60. It has been found that such a flow circulation enhances the uniformity of distribution of fluid through the cell 60 to improve the quality of the developed product and to effectively utilize the relatively small quantity of working fluid to which the PSM is exposed during a development process.

Another advantage provided by the circulation pump 130 relates to the mixing of fluid contained within the cavity 72 with fresh fluid introduced into the cell 60. More specifically, when it is needed to introduce fresh fluid into the cavity 72 to replenish some of the spent fluid contained therein, the circulation pump 130 encourages prompt mixing (within the cavity 72) of the fresh fluid with the spent fluid so that the fluid within the cell 60 is maintained in a homogeneous condition. As depicted in FIG. 6, an arrangement found to be well-suited for introducing fresh solution into the cavity 72 includes a conduit 142 leading from the reservoir 36 and connected in flow communication with the hose 134 by means of a T-fitting 144. Another conduit 146 is connected in flow communication with the hose 136 by means of a T-fitting 148 and terminates above the overflow container 51 for draining from the hose network 132 an amount which generally corresponds with the amount of fresh solution added to the network 132 by way of the conduit 146. In the depicted system, a metered pump 150 is connected in-line with the conduits 142, and a metered pump 153 is connected in-line with the conduit 146. Each pump 142 or 146 is suitably wired to the controller 58 for controlling the introduction of fluid into and the draining of fluid from the hose network 132.

A related arrangement including a conduit 152 joined in flow communication between the conduit 142 and a fresh water source 154 can be used to clean the cavity 72 and associated hoses of the hose network 132 and/or fill the cavity 72 with water if the cell 60 is intended to remain inoperative for a relatively long period of time. The conduit 142 is joined to the conduit 142 with a T-fitting 158, and a metered pump 156 is connected in-line with the conduit 142 for control of the flow of water from the source 154 into the hose network 132. When it is desired to clean the cavity 72, the metered pump 156 is actuated (by way of the controller 58) to direct water from the source 154 through the network 132 while the metered pump 153 is opened to permit effluent to drain from the network 132 for disposal. The pump 130 continues to circulate solution and water through the cavity in a manner which continually mixes the water with and rinses solution from the cavity 72 until, for example, the cavity 72 is sufficiently rinsed and/or the fluid contained within the cavity is a water-rich mixture. Thus this arrangement which accommodates the introduction of water into the cavity 72 provides means by which the cell 60 can be easily, automatically and economically cleaned.

With reference to FIG. 7–12, there is illustrated another embodiment of a reservoir cell 160 which can be used within the system 21 in place of the previously-described embodiment 60. By way of example, the depicted cell 160 is situated at the FIG. 2 station 26 for containing a developer solution but it will be understood that the cell 160 could be utilized at an alternative station of the system 21. Like the cell 60 of FIGS. 3–6, the cell 160 is elongated in shape and has top and bottom sections 162 and 164, respectively, which collectively provide an internal cavity 166 for containing a working fluid, such as a processing, fixing or developer solution. The bottom section 164 includes a recess-defining section 163 which is similar in construction to the bottom section 66 of the cell 60 of FIG. 3–6 and accordingly bears the same reference numerals.

The top section 162 includes a platen body 165 having a forward portion 168 which is spaced from the forward edge 80 of the bottom section 164 for a distance therealong so as to provide an elongated entrance passageway 170 through which the PSM is introduced into the cavity 166. Associated with the forward portion 168 is a blade 172 which depends downwardly therefrom and is in contact with the bottom section 164 adjacent the forward edge 80. During use of the cell 160, the blade 172 directs the leading edge of the PSM into the cell cavity 166 along a path having a downwardly-directed component as well as a rearwardly-directed component to ensure that the leading edge of the PSM is submerged within the processing solution as the PSM enters the cavity 166. To this end, the blade 172 is constructed of a relatively thin, e.g., 0.002 to 0.01 inches in thickness, polyester strip (but other materials can be used) and includes an upper portion which is secured along its length to the forward portion 168 of the top section 162 with a rail piece 174 and screws 176 so that the blade 172 is canted rearwardly with respect to the top section 162 as a path is traced along the face of the blade 172 from it supper portion toward the bottom edge thereof.

Figure 8:
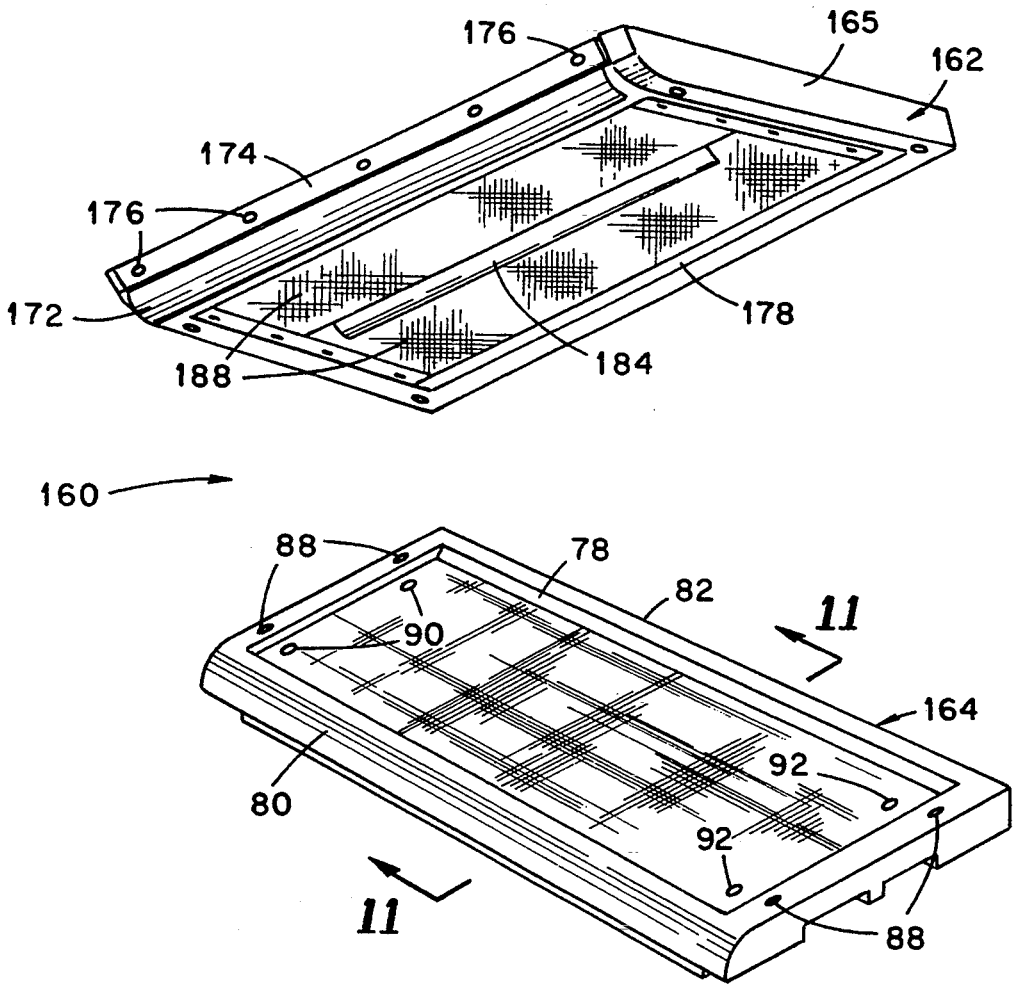
FIG. 8 is a perspective view of the reservoir cell of FIG. 7, shown exploded.
Figure 9:
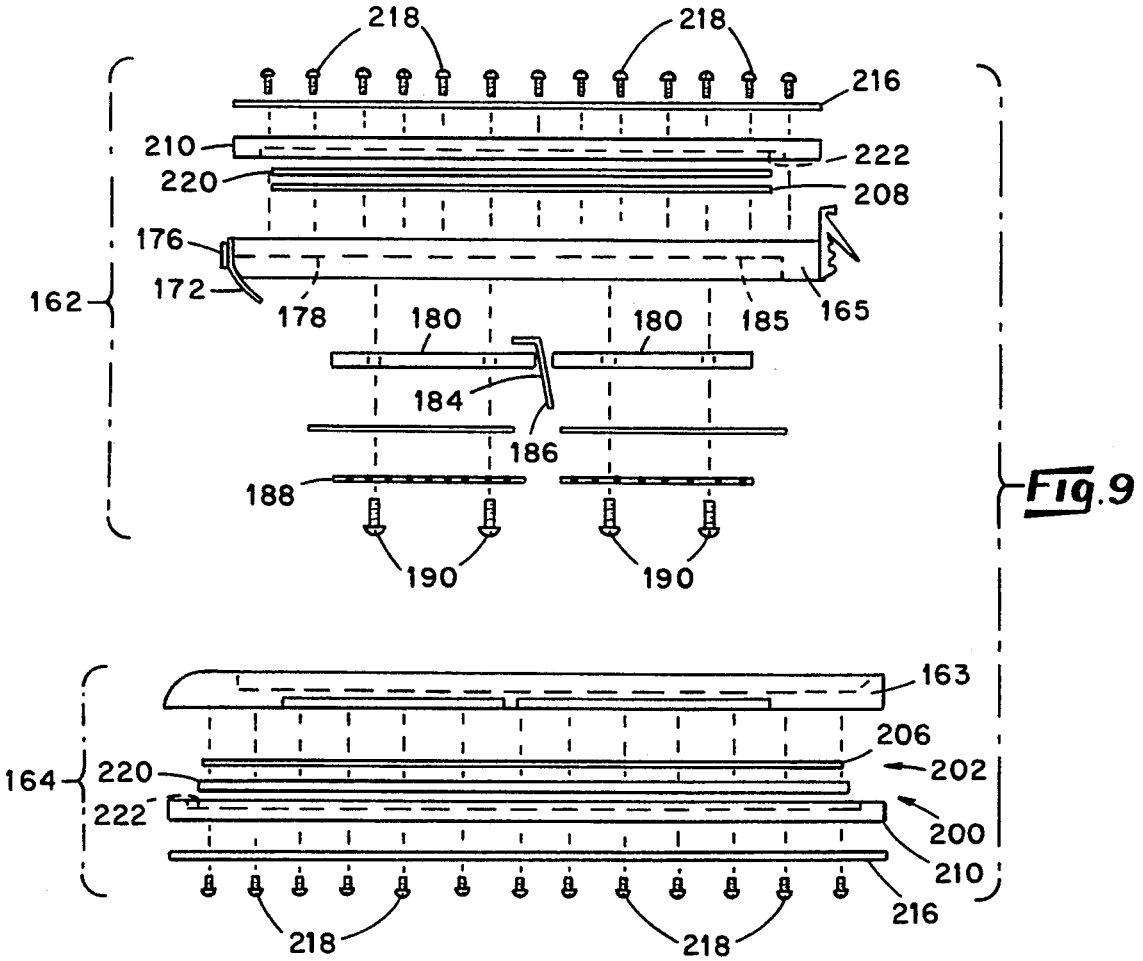
FIG. 9 is an end elevation view of the FIG. 7 cell, shown exploded.
Figure 10:
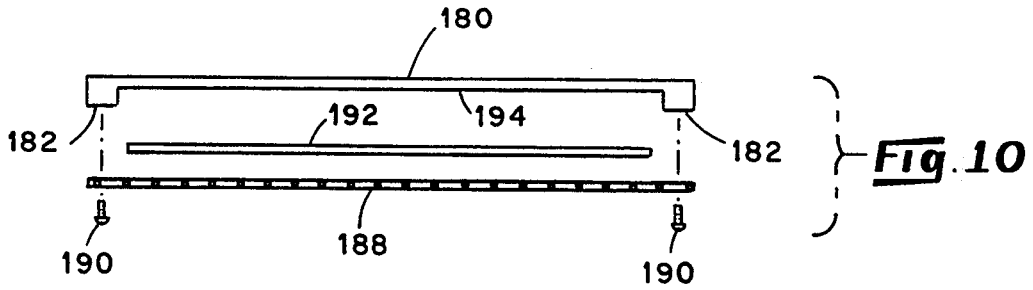
FIG. 10 is a front elevation view of various components of the FIG. 7 cell, shown exploded.

As best shown in FIGS. 8–10, the platen body 165 of the top section 162 is provided with a downwardly-opening recess 178 and a pair of elongated plate members 180 fixedly secured, as with screws 190, against the downwardly-facing face of the recess 178. Each plate member 180 includes a central portion 194 bounded at each end by a downwardly-depending shoulder 182. The members 180 are disposed within the recess 178 in a side-by-side arrangement and possess such a length so as to span a major portion of the length of the recess 178. In the depicted cell 160, a blade 184 formed from a thin polyester sheet has an upper portion which is sandwiched between one of the plate members 180 and the face, indicated 185 in FIG. 9, of the top section body 165 and extends downwardly between the plate members 180. The lower edge portion, indicated 186 of the blade 184 is canted rearwardly with respect to the remainder of the cell 160 and is situated adjacent the bottom surface of the cavity 166. As a PSM is moved through the cell cavity 166, the lower edge portion 186 engages the upper face of the PSM and the resiliency of the blade 184 prevents the PSM from floating upwardly out of the solution contained within the cell 160.

The cell 160 also includes a screen assembly comprised of a pair of fine-meshed screens 188. Each screen 188 in the depicted cell 160 is attached at its opposite end to the shoulders 182 with the screws 190 so that each screen 188 is held in a taut condition between the shoulders of the corresponding member 180. As a PSM is routed through the cell cavity 166, the screens 188 cooperate with the moving PSM to disperse processing solution adjacent the upper face of the PSM to increase the exposure of the emulsion-bearing face of the PSM to less-depleted solution within the cell cavity 166. Accordingly, the screens 188 are positioned within the cavity 166 so that as a PSM passes therethrough, the screens 188 are in relatively close proximity to the upper face of the PSM. The screens 188 are therefore advantageous in that they help to maintain the processing solution on the upper face of the PSM.

Figure 7:
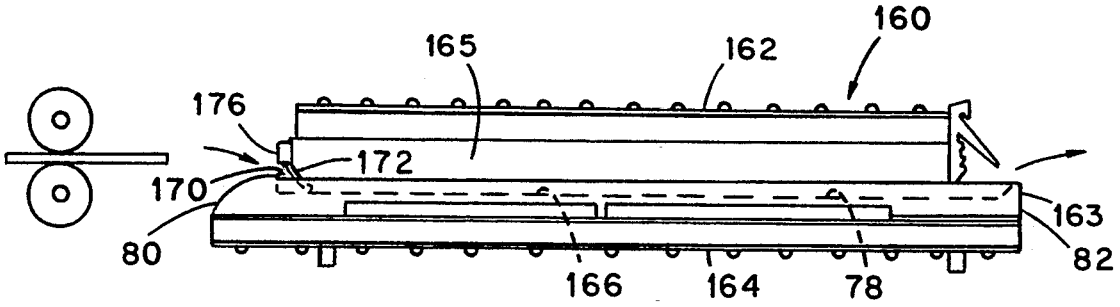
FIG. 7 is a view similar to that of FIG. 3 illustrating another embodiment of a reservoir cell for the FIG. 1 equipment.

In the cell 160, the amount of processing solution which can be contained within the cavity 166 is limited by the height of the entrance and exit passageways of the cell 160. More specifically, and as best seen in FIG. 7, the entrance passageway 170 and exit passageway, indicated 171, provide an overflow through which solution spills out of the cavity 166 if too much solution is introduced therein. Therefore, in the depicted cell 160, the fill level of the processing solution contained within the cavity 166 corresponds generally with (taking into consideration the heaping of fluid within the cavity 166 due to the surface tension existing between molecules of the fluid) the height of the upper surface of the forward and rearward edges 80, 82 of the bottom section 164. The fill level, i.e., the heaped fill level, of solution within the cell 160 is indicated 196 in FIG. 11 and is spaced from the underside of the plate members 180 by a spacing 198, and the screens 188 are supported within the cavity 166 so that the positions of the screens 188 correspond with the heaped fill level of the solution so that the upper surface of the solution is maintained at least as high as the upper face of the screens 188, and control, to an extent, the thickness of the sheet-like form of the solution.

Figure 11:
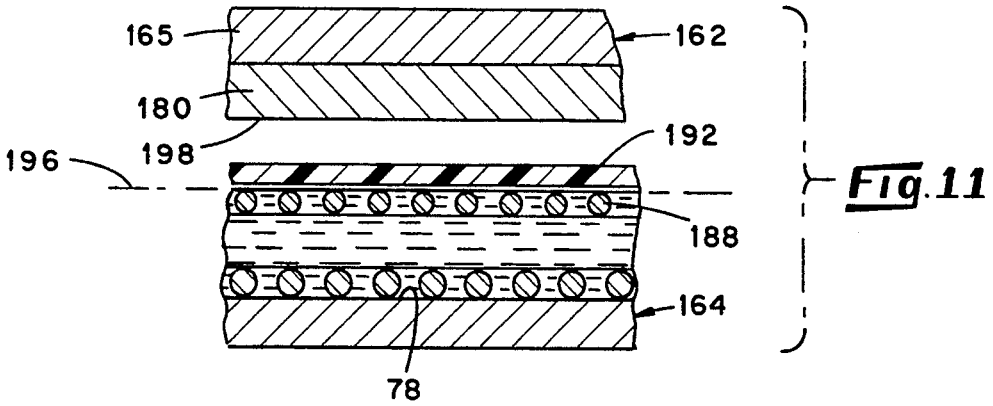
FIG. 11 is a cross-sectional view taken about along line 11—11 of FIG. 8 of a fragment of the FIG. 7 cell when filled with working solution for use.

As best shown in FIGS. 10 and 11, the cell 160 also includes a pair of substantially air-impermeable, flat strips 192 of material disposed beneath the screens 188 and the central portions 194 of the plate members 180. Each strip 192 extends along a major portion of the length of the cell cavity 166 and has a width which corresponds generally with the width of a corresponding one of the plate members 180 so that when positioned in the spacing provided between the central portion 194 of a corresponding plate member 180 and a screen 188, the strips 192 collectively span a substantial portion, i.e., at least three-fourths, of the upper surface of the solution contained within the cavity 166. In the depicted cell 160, each strip 192 is constructed out of a relatively thin, e.g. 0.002 to 0.005 inches in thickness, polyester sheet, but other materials can be used.

When the cell cavity 166 is filled with solution to its (heaped) fill level 196, the strips 192 engagably overlie a substantial portion of the upper surface of the solution. It has been found that when the upper level of the solution is about level with the level of the screens 188, the solution is drawn into contact with the underside of the strips 192 through the screens 188 under the influence of surface tension and is maintained in engagement with the underside of the strips 188 in a cohering relationship therewith. With the strips 192 engagably overlying a substantial portion of the upper surface of the processing solution as described above, the covered portions of the upper surface of the processing solution are thereby isolated from air disposed in the spacing 198 above the processing solution. Thus, the strips 188 reduce the likelihood of oxidation of the processing solution if left within the cell 160 for a substantial period of time. Such an advantage can be readily appreciated when considering the existence of processing solutions, or developers (with high pH), which are highly susceptible to oxidation.

Figure 12:
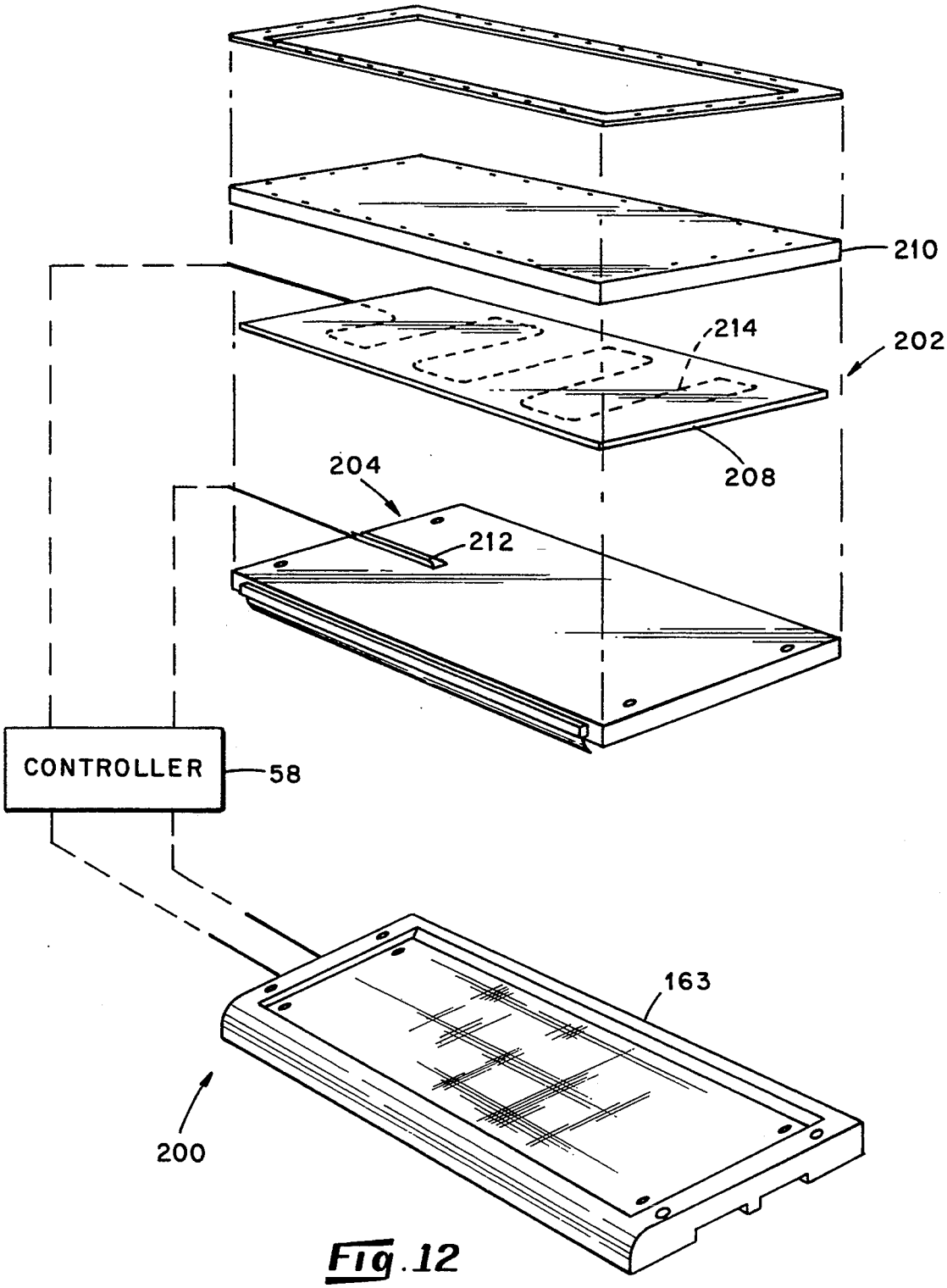
FIG. 12 is a view similar of the FIG. 7 to that of FIG. 8 but illustrating the top section of the cell when in an exploded condition.

For purposes of controlling the temperature of a processing operation performed with the cell 160 and with reference to FIGS. 9 and 12, the system 21 includes means, generally indicated 200, for controlling the temperature of the upper and lower sections 162, 164 to thereby control the temperature of the working fluid, e.g., processing solution, contained within the cell cavity 166. In the depicted embodiment, the temperature-controlling means 200 includes means, generally indicated 202, for heating the bodies 165, 163 of the top and bottom sections 162, 164 and means, generally indicated 204, for monitoring the temperature of the upper and lower sections 162, 164. The heating means 202 includes a flexible, e.g. rubber, heating pad 206 secured in heat exchange relationship with the underside of the body 163 of the bottom section 166 and a flexible, e.g., rubber heating pad 208 secured in heat exchange relationship with the upper face of the body 165 of the top section 162. Each pad 206 or 208 includes an electric heating element 214 embedded within material of the pad 206 or 208 along a serpentined path depicted in dotted lines in FIG. 12. Each heating pad 206 or 208 is suitably wired to a power source by way of the controller 58 as shown in FIG. 12 for receiving electrical current therefrom.

For urging the heating pad 206 or 208 against the corresponding body 165 or 163 and with reference again to FIG. 9, a secondary plate 210 is positioned on the side of the pad 206 or 208 opposite the body 165 or 168, and a piece 220 of elastomeric, flexible foam is interposed between the pad 206 or 208 and the plate 210. In this connection, each plate 210 provides a recess 222 sized to accept the foam piece 220 and pad 206 or 208 placed therein in a compressed condition so that when the plate 210 is secured against the corresponding body 165 or 163 of the top and bottom sections 162 and 164, as with edge rails 216 and screws 218, the memory of the foam piece 220 urges the pad 206 or 208 into contact with the body 165 or 163. For satisfactory transfer of heat from the pad 206 or 208 to the working fluid contained within the cavity 166, the bodies may be constructed out of any number of materials, such as polyvinyl chloride (PVC) or a temperature stable, glass-filled plastic such as is commercially available under the trade designation Noryl®. In addition, the location along which the edge of each secondary plate 210 meets the corresponding body 165 or 163 can be sealed with a Teflon® foam gasket.

For controlling the ON/OFF operation of the heating pads 206 and 208 and with reference again to FIG. 12, the system 21 includes a temperature sensor 212 embedded within a groove 224 formed within the body of the corresponding top or bottom section 162 or 164 and adjacent the heating pad 206 or 208. The sensor 212 is connected to the controller 58 for transmitting signals therefrom, which signals correspond to the temperature of the corresponding top or bottom section 162 or 164. The controller 58 is, in turn, programmed to maintain the temperature of the cell 160 within a predetermined temperature range.

Another advantage provided by the temperature-controlling means 200 relates to the relatively expansive surface area of the interior of the cavity 166, and in particular, that of the bottom section 164 which is in contact with the solution contained within the cavity 166. Because this relatively small amount of solution contacts such a large surface area of the bottom section 164, i.e., the bottom of the recess provided in the bottom section 164, the solution can be heated rapidly by the heating pad 206 (FIG. 9) to the desired temperature. Thus, the temperature control means 200 reduces the amount of time required to heat solution at the processing stations to an operating temperature and to compensate for a loss of the heat from the solution.

It will be understood that numerous modifications and substitutions can be had to the aforedescribed embodiments without departing from the spirit of the invention. For example, although the cell embodiment 60 of FIGS. 3–6 has been shown and described as being devoid of means for controlling the temperature of the upper and lower sections 64, 66 of the cell 60, a reservoir cell in accordance with the broader aspects of the present invention may possess structural features comparable to that of the cell 60 and also include such temperature-controlling means. Furthermore, although each of the cell embodiment 60 of FIGS. 3–6 and the cell embodiment 160 of FIGS. 7–12 has been shown and described as being positioned (in the alternative) at the first station 26, each cell 60 or 160 can be positioned any of the other stations of the system 21. Accordingly, the aforedescribed embodiments are intended for the purpose of illustration and not as limitation.

I claim:

1. A system for use in the processing of a photographic sheet material having photographic emulsion on at least one of the faces thereof, the system comprising:

a reservoir having an elongate cavity for containing a relatively small amount of processing solution through which the material is moved during a processing operation, the cavity having two opposite ends and a substantially flat bottom surface therebetween, said bottom surface being substantially covered with bottom fabric means that is secured thereto and wetted by processing solution contained therein;

top fabric means supported within the cavity structure above said cavity for cooperating with the material as the material is moved through the cavity for dispersing the processing solution in contact with the emulsion-bearing face of the material; and inlet and outlet conduit means associated with the reservoir for moving processing solution across said bottom surface from one end of the cavity to the other end of the cavity at a depth substantially corresponding to the thickness of said bottom fabric means to enhance the distribution of processing solution across an emulsion-bearing face of the material during a processing operation.

2. The system as defined in claim 1 further comprising means for introducing fresh processing solution into the one end of the cavity so that as the processing solution is moved from one end of the cavity to the other end of the cavity, the fresh solution introduced at the one end thoroughly mixes with the solution within the cavity.

3. The system as defined in claim 1 wherein the reservoir includes an inlet port adjacent one end of the cavity and an outlet port adjacent the opposite end of the cavity and the associated means includes means for circulating the processing solution through the cavity from the inlet port to the outlet port.

4. The system as defined in claim 3 wherein the circulating means includes means connected to the inlet port and the outlet port for providing with the cavity a continuous loop passageway and means for pumping the processing solution through the loop passageway so that at least a portion of the processing solution which exits the cavity through the outlet port is re-directed into the cavity through the inlet port.

5. The system as defined in claim 4 further comprising means for introducing fresh processing solution into the continuous loop passageway so that fresh solution is directed to the cavity through the inlet port with the re-directed solution and is thoroughly mixed with solution within the cavity as the solution is moved from one end of the cavity to the other end of the cavity.

6. The system as defined in claim 4 wherein the pumping means is adapted to circulate processing solution through the cavity at a relatively slow rate of flow.

7. A method for processing a flexible photographic sheet material having a photographic emulsion on at least one of the faces thereof comprising the steps of:

providing a reservoir having an elongate cavity through which a flexible photographic sheet material is moved during a processing operation and a relatively small amount of processing solution contained within the cavity wherein the cavity is shaped so that the processing solution contained therein dispersing means secured to a bottom surface assumes the form of a sheet-like body; additional dispersing means supported within the reservoir from cavity cover means cooperative with a photographic sheet material moving through the cavity so that processing solution in contact with an emulsion-bearing face of the photographic sheet material is dispersed; and moving the processing solution from one end of the cavity to the other end of the cavity so that as the material is moved through the cavity, the distribution of processing solution across the emulsion-bearing face of the material is enhanced.

8. The method as defined in claim 7 wherein the step of moving is preceded by a step of introducing fresh processing solution into the one end of the cavity so that as the processing solution is moved from one end of the cavity to the other end of the cavity, the fresh solution introduced at the one end thoroughly mixes with the solution contained within the cavity.

9. The method as defined in claim 8 further comprising a step of withdrawing solution from the cavity in coordination with the step of introducing fresh solution to the cavity.

10. The method as defined in claim 7 wherein the step of moving is followed by a step of introducing water into the one end of the cavity for rinsing solution from the cavity and a step of withdrawing solution from the cavity in coordination with the step of introducing water to the cavity.

11. Apparatus for use in the processing of a flexible photographic sheet material having at least one photographic emulsion on at least one of the faces thereof, the apparatus comprising:

a reservoir having an elongate cavity for containing a relatively small amount of processing solution through which a flexible photographic sheet material is moved during a processing operation, the cavity having a roof and a shape so that processing solution contained within the cavity assumes the shape of a substantially sheet-like body and has an upper surface which is spaced from the roof of the cavity so as to provide a spacing between the upper surface of the processing solution contained within the reservoir and the roof of the cavity;

means supported within the cavity and cooperable with the photographic sheet material as the material is moved through the cavity for dispersing the processing solution in contact with the emulsion-bearing face of the photographic sheet material; and means disposed within the cavity for engagably overlying a substantial portion of the upper surface of the processing solution contained within the cavity to isolate the substantial portion of the upper surface from said spacing to reduce the likelihood of oxidation of the processing solution from air contained within the spacing.

12. The apparatus as defined in claim 11 wherein the means for engagably overlying includes a relatively thin sheet of substantially air-impermeable material for engagably overlying an appreciable portion of the upper surface of the processing solution.

13. The apparatus as defined in claim 12 wherein the dispersing means includes a screen member supported beneath the roof of the cavity so as to be positioned slightly above a face of the material as the material is moved through the body of processing solution, and the means for engagably overlying includes a relatively thin sheet of substantially air-impermeable material positioned between the screen member and the roof of the cavity for engagably overlying an appreciable portion of the upper surface of the processing solution contained within the cavity.

14. The apparatus as defined in claim 11 wherein the dispersing means includes a plurality of screen members secured in a relatively taut condition beneath the roof of the cavity so as to be supported above a photographic sheet material moved therethrough, and the means for engagably overlying includes a plurality of thin sheets of substantially air-impermeable material wherein each material sheet is supported above the cavity by a corresponding screen member and the collective size of the material sheets is sufficient to engagably overlie a major portion of the upper surface of the processing solution.

15. Apparatus for use in the processing of a flexible photographic sheet material having a photographic emulsion on at least one of the faces thereof, the apparatus comprising:

a reservoir including means defining an elongate cavity for containing a relatively small amount of processing solution through which a flexible photographic sheet material is moved during a processing operation, said cavity having a substantially flat bottom surface covered with at least one thickness of fabric that is secured to said bottom surface;

inlet and outlet conduit means associated with said reservoir for moving processing solution across said bottom surface from one end of the cavity to the other at a depth substantially corresponding to the thickness of said bottom surface fabric;

top fabric supported from above the cavity and cooperable with the photographic sheet material as the material is moved through the cavity for dispersing the processing solution in contact with an emulsion-bearing face of the material: and means associated within the reservoir for controlling the temperature of the reservoir to thereby control the temperature of the processing solution contained within the reservoir.

16. The apparatus as defined in claim 15 wherein the cavity-defining means includes two platen bodies arranged in a substantially face-to-face arrangement so that the opposing faces of the platen bodies are shaped to collectively provide the cavity and the temperature-controlling means includes means for controlling the temperature of at least one of the platen bodies.

17. The apparatus as defined in claim 16 wherein the means for controlling the temperature includes means for heating at least one of the platen bodies and means associated with the heating means for monitoring the temperature of the one platen body so that the temperature of the platen body is maintained within a predetermined range.

18. The apparatus as defined in claim 17 wherein the heating means includes an electric heating element secured in heat exchange relationship with the one platen body so that heat absorbed by the one platen-like body from the heating element is transmitted through the one platen-like body to the solution.

19. The apparatus as defined in claim 17 wherein the means for controlling the temperature of the one platen body includes a temperature sensor secured in heat exchange relationship with the one platen body.

20. A method for processing a flexible photographic sheet material having a photographic emulsion on at least one of the faces thereof comprising the steps of:

providing a reservoir having an elongate cavity with two opposite ends and a substantially flat bottom surface therebetween;

covering said cavity bottom surface with at least one thickness layer of bottom fabric secured thereto in juxtaposition with said bottom surface;

supplying processing solution to said cavity in a movement across said bottom surface from one end of said cavity to the other end;

controlling said processing solution depth in substantial correspondence with the thickness of said bottom fabric;

moving a flexible photographic sheet material between and said bottom fabric and a top fabric supported from above said cavity to disperse said processing solution over an emulsion-bearing face of said materials; and controlling the temperature of the processing solution contained within the reservoir by heat sources adjacent said cavity.

21. The method as defined in claim 20 wherein the reservoir includes two platen bodies arranged in a substantially face-to-face arrangement so that the opposing faces of the platen bodies are shaped to collectively provide the cavity, and the step of controlling the temperature of the reservoir includes a step of heating at least one of the platen bodies as required to maintain the one platen body within a predetermined temperature range.

* * * * *